US006843207B2

(12) United States Patent
Kanzaki et al.

(10) Patent No.: US 6,843,207 B2
(45) Date of Patent: Jan. 18, 2005

(54) WATER SUPPLY TANK UNIT

(75) Inventors: Kouji Kanzaki, Yamatokoriyama (JP); Toshifumi Kamiya, Yamatotakada (JP); Yuji Hayakawa, Shiki-gun (JP); Takashi Sugimoto, Yokohama (JP); Yasuhiko Inoue, Yokohama (JP); Yukikazu Niizawa, Yokohama (JP)

(73) Assignees: Matsushita Electric Industrial Co., Ltd., Osaka (JP); Nifco Inc., Kanagawa (JP)

( * ) Notice: Subject to any disclaimer, the term of this patent is extended or adjusted under 35 U.S.C. 154(b) by 0 days.

(21) Appl. No.: 10/653,743

(22) Filed: Sep. 2, 2003

(65) Prior Publication Data

US 2004/0076412 A1 Apr. 22, 2004

(30) Foreign Application Priority Data

Sep. 3, 2002 (JP) ..... P 2002-257953

(51) Int. Cl.[7] ..... F22B 1/02
(52) U.S. Cl. ..... 122/31.1; 122/30; 261/DIG. 65
(58) Field of Search ..... 122/20 R, 31.1, 122/30, DIG. 11, DIG. 10; 261/DIG. 65; 360/99.02, 99.06, 99.07

(56) References Cited

U.S. PATENT DOCUMENTS

| | | | | |
|---|---|---|---|---|
| 1,557,997 A | | 10/1925 | Erickson | |
| 1,589,428 A | | 6/1926 | Rosenow | |
| 1,646,566 A | | 10/1927 | Warner | |
| 5,048,304 A | * | 9/1991 | Takeuchi | 62/305 |
| 5,242,375 A | | 9/1993 | McDonough | |
| 5,339,383 A | | 8/1994 | Marino | |
| 5,359,478 A | * | 10/1994 | Kawano | 360/96.6 |
| 5,525,782 A | * | 6/1996 | Yoneno et al. | 219/682 |
| 5,636,319 A | | 6/1997 | Glucksman et al. | |
| 6,052,511 A | | 4/2000 | Birdsell | |
| 6,239,945 B1 | * | 5/2001 | Inoue et al. | 360/99.02 |
| 6,285,829 B1 | | 9/2001 | Smith | |
| 6,515,266 B2 | * | 2/2003 | Nasu et al. | 219/739 |

FOREIGN PATENT DOCUMENTS

| | | |
|---|---|---|
| EP | 0 952 400 | 10/1999 |
| GB | 1 333 508 | 10/1973 |
| JP | 9-101034 | 8/1998 |

* cited by examiner

*Primary Examiner*—Gregory Wilson
(74) *Attorney, Agent, or Firm*—Pearne & Gordon LLP

(57) ABSTRACT

A water supply tank unit, attached to a heating apparatus having a moistening function, comprising an open/close member biased in a direction of departing from a unit body attached to the heating apparatus, and a water supply tank held in the open/close member so as to be attachable/detachable, wherein the water supply tank and the open/close member have protrusions respectively so that the protrusions climb over each other and are locked to each other in a process of attaching/detaching the water supply tank.

7 Claims, 20 Drawing Sheets

WATER SUPPLY TANK UNIT

BACKGROUND OF THE INVENTION

The present invention relates to a water supply tank unit for storing a water supply tank which supplies moistening water to a heating apparatus having a moistening function.

As microwave heating apparatuses in the related art, there are a single function type apparatus for performing only microwave heating, a combination oven having a convection heater for generating hot air in addition to microwave heating, and so on. A microwave heating apparatus capable of supplying microwave and stream into a heating chamber has been also discussed.

As disclosed in JP-A-09-101034 (Japanese Application Publication Number: Hei 09-101034), for the microwave heating apparatus to which a moistening function is added, various methods such as a method of generating steam from a boiler provided outside the heating chamber and introducing the steam into the heating chamber have been proposed.

The microwave heating apparatus to which such a moistening function for generating steam is added has a water supply tank that can be attached/detached to/from a storage space formed in an exterior. Water in the water supply tank is dripped into the boiler by a water feed pump.

Incidentally, in the recent microwave heating apparatus, an operation panel of the microwave heating apparatus has been arranged in a door portion or a control circuit has been arranged near the bottom for the requirement of increase in volume of the heating chamber and reduction in size of the apparatus as a whole.

In the microwave heating apparatus formed so that the water supply tank can be attached/detached to/from the storage space formed outside the apparatus, the storage space has to be provided as a large space for setting the water supply tank detachably. This however causes difficulty of attaining increase in volume of the heating chamber and reduction in size of the apparatus as a whole.

It may be therefore conceived that the water supply tank is stored in a narrow space between the heating chamber and an exterior panel in a side portion of the apparatus. When a storage portion for storing the water supply tank is provided in this space, it is however difficult to store the water supply tank in the storage space steadily and connect a water supply port of the water supply tank to a water intake port on the apparatus side steadily. Furthermore, it is difficult to check whether the water supply port is connected to the water intake port steadily or not, so that there is the possibility that water leakage in the apparatus may be caused by failure in the connection.

SUMMARY OF THE INVENTION

The invention is developed in consideration of the problem in the related art and an object of the invention is to provide a water supply tank unit in which: a water supply tank is stored steadily; a water supply port is connected to a water intake port steadily; and water is supplied to a heating apparatus side without water leakage so that a moistening function of the heating apparatus can be effectuated well.

To achieve the foregoing object, the invention provides a water supply tank unit attached to a heating apparatus having a moistening function, the water supply tank unit including: a unit body attached to the heating apparatus; an open/close member including a support portion for supporting the open/close member to the unit body on one side so as to make the open/close member opened/closed freely, and a lock portion for locking the open/close member on the unit body on the other side, the open/close member biased in a direction of departing from the unit body; an operation member including an engagement portion engaged with the lock portion to keep the open/close member locked on the unit body, and a push button for unlocking the open/close member by a pushing-down operation of the push button; and a water supply tank held in the open/close member so as to be attachable/detachable, wherein the water supply tank and the open/close member have protrusions respectively so that the protrusions climb over each other and are locked to each other in a process of attaching/detaching the water supply tank.

In the water supply tank unit, the protrusions are provided so that the protrusions climb over each other and are locked to each other when the water supply tank is attached/detached to/from the open/close member. Hence, the attachment of the water supply tank into the open/close member can be ensured by the locking of the protrusions to each other and the state of attachment of the water supply tank can be confirmed. Accordingly, even when, for example, it is difficult to store the water supply tank and confirm the attachment of the water supply tank because of the structure in which the water supply tank is stored in a narrow space in the apparatus, a water supply port of the water supply tank can be connected to a water intake port of the heating apparatus steadily. Water can be supplied to the heating apparatus side without water leakage, so that the moistening function of the heating apparatus can be effectuated well.

Preferably, in the water supply tank unit according to the invention, the open/close member has at least one guide wall which is provided along a direction of attaching the water supply tank and which abuts on the water supply tank to be attached in order to guide an attaching/detaching operation of the water supply tank.

In the water supply tank unit, the water supply tank is guided in the attaching direction by the guide wall. Hence, the water supply tank can be attached to a required position steadily.

Preferably, in the water supply tank unit according to the invention, the water supply tank has at least one rib which is provided along a direction of attaching the water supply tank and which abuts on the open/close member in order to guide the water supply tank to a water supply tank retention position in the open/close member.

In the water supply tank unit, the water supply tank is guided to the water supply tank retention position by the rib pence, the water supply tank can be attached to a required retention position steadily.

Preferably, in the water supply tank unit according to the invention, the open/close member has at least one guide wall which is provided along a direction of attaching the water supply tank and which abuts on the water supply tank to be attached in order to guide an attaching/detaching operation of the water supply tank; the water supply tank has at least one rib which is provided along a direction of attaching the water supply tank and which abuts on the open/close member in order to guide the water supply tank to a water supply tank retention position in the open/close member; and the guide wall of the open/close member and the rib of the water supply tank are slid while engaged with each other when the water supply tank is attached/detached.

In the water supply tank unit, the water supply tank is guided to the water supply tank retention position by the engagement of the guide wall and the rib. Hence, the water supply tank can be attached to a required retention position steadily.

Preferably, in the water supply tank unit according to the invention, the open/close member further has a water supply tank detection unit for detecting attachment/detachment of the water supply tank.

In the water supply tank unit, the state of attachment of the water supply tank into the open/close member can be checked by the water supply tank detection unit.

Preferably, in the water supply tank unit according to the invention, the water supply tank detection unit detects a state in which the water supply tank is attached into the open/close member and a state in which the water supply tank is detached from the open/close member; the water supply tank detection unit has: a driven member which is provided in the open/close member so as to be biased in a direction reverse to the direction of attaching the water supply tank and which is slid together with the water supply tank when pressed by part of the water supply tank inserted; and a switch for changing a state reversibly according to the sliding of the driven member.

In the water supply tank unit, the driven member is moved by the attachment of the water supply tank into the open/close member to thereby operate the switch. Hence, the state of attachment of the water supply tank can be checked easily on the basis of the operating state of the switch.

Preferably, in the water supply tank unit according to the invention, the water supply tank has a pawl portion provided at a rear end in the direction of attaching the water supply tank into the open/close member so that a length of protrusion of the pawl portion backward in the attaching direction increases backward in a direction of pushing the open/close member into the unit body side.

In the water supply tank unit, the water supply tank is pushed in the attaching direction by the pushing force of the open/close member while the pawl portion abuts on part of the unit body when the open/close member is pushed into the unit body side. Hence, the steady attachment state of the water supply tank can be ensured.

DESCRIPTION OF THE PREFERRED EMBODIMENT

A preferred embodiment of a water supply tank unit according to the invention will be described below in detail with reference to the drawings.

Incidentally, the description will be made while a microwave heating apparatus is taken as an example of a heating apparatus having a moistening function provided with the water supply tank unit.

Figure 1:
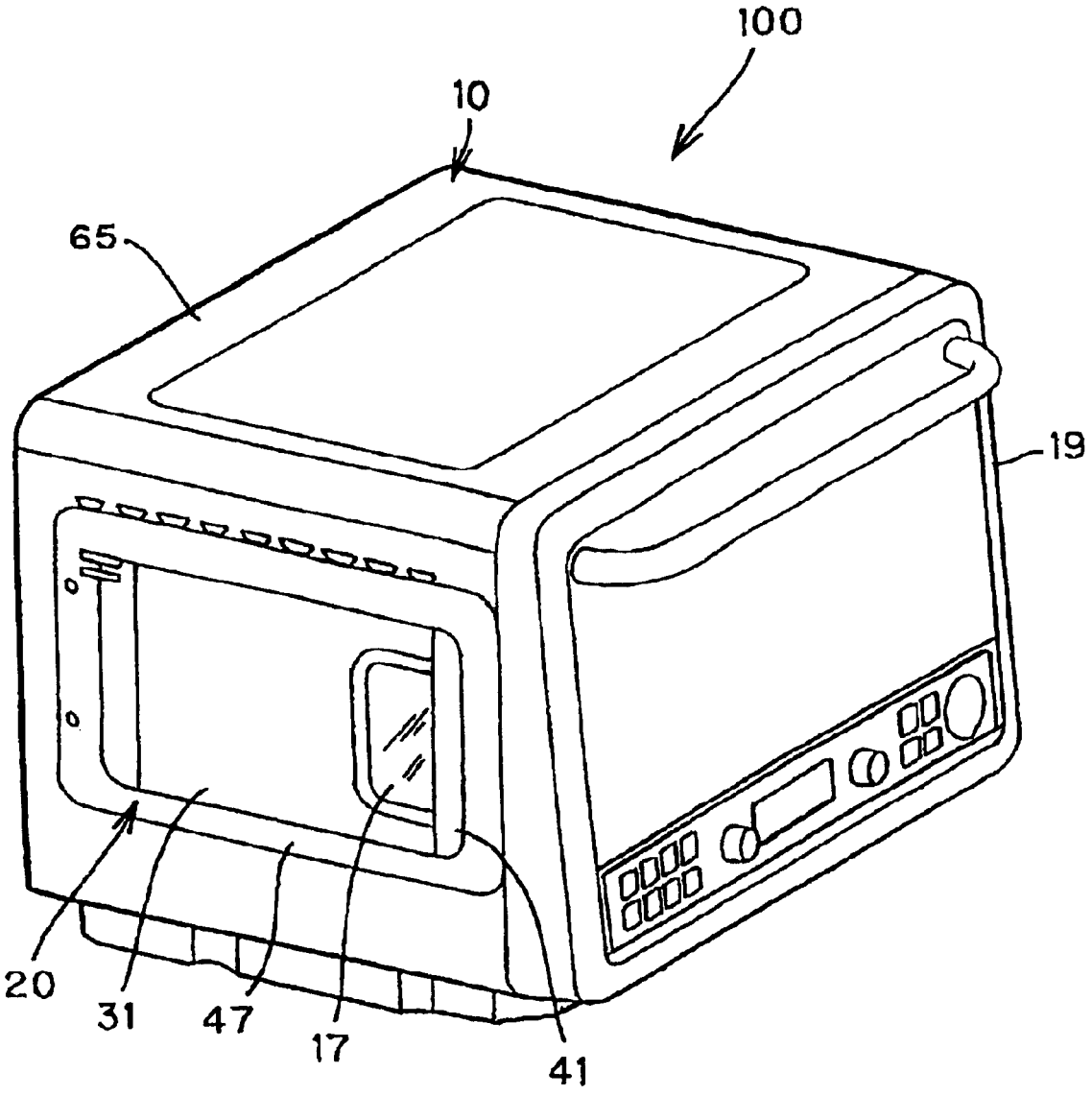
FIG. 1 is a perspective view showing the external appearance of a microwave heating apparatus according to the invention.
Figure 2:
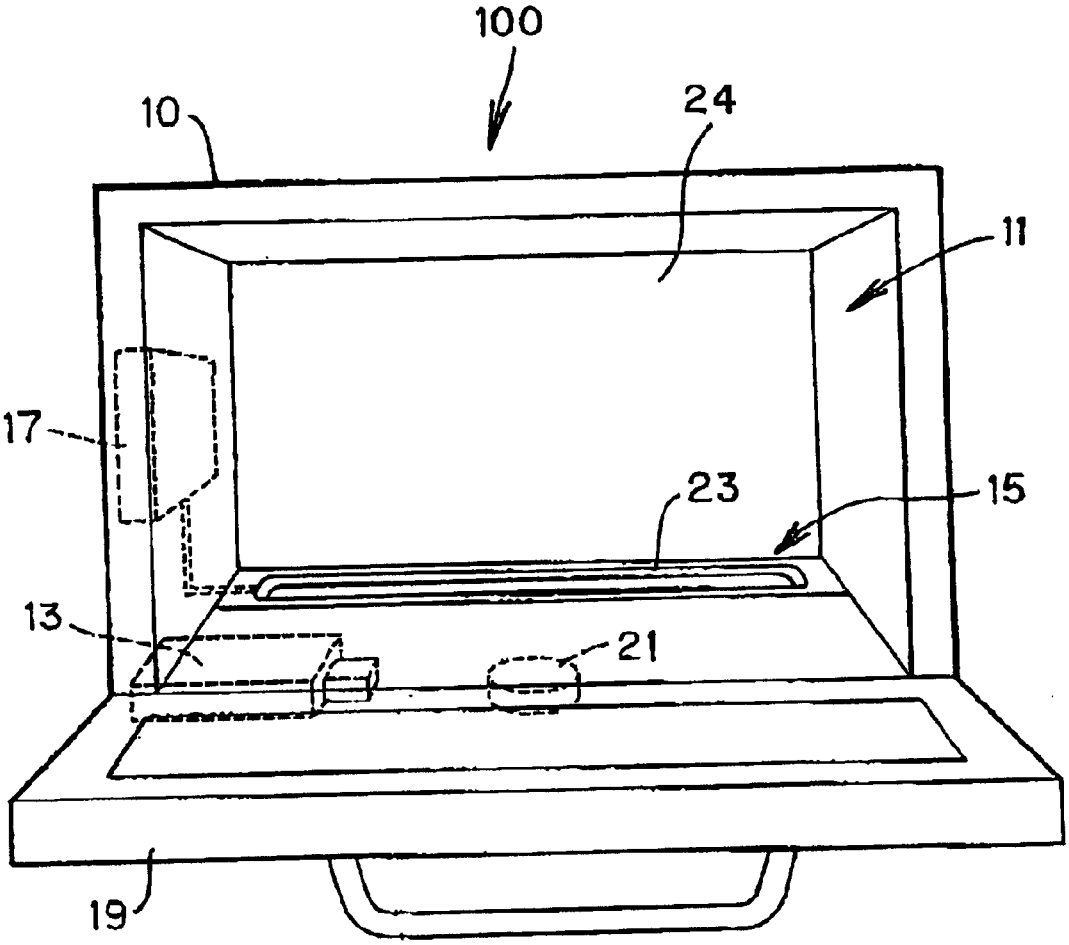
FIG. 2 is a schematic front view showing a state in which an open/close door of the microwave heating apparatus is opened.

FIG. 1 is a perspective view showing the external appearance of the microwave heating apparatus according to the invention. FIG. 2 is a schematic front view showing a state in which an open/close door of the microwave heating apparatus is opened.

As shown in FIG. 1, the invention has a special feature in that a water supply tank unit 20 in which a water supply tank 17 for supplying water into a steam generating portion provided for moistening the microwave heating apparatus 100 is stored is provided on a side of the microwave heating apparatus 100, and in that the water supply tank 17 is connected steadily. First, the basic configuration and operation of the microwave heating apparatus 100 as a heating apparatus will be described.

As shown in FIG. 1 and FIG. 2, the microwave heating apparatus 100 is a heating cooker for heating a subject to be heated by supplying at least one of microwave and steam into a heating chamber 11 where the subject is housed. The microwave heating apparatus 100 has, as main constituent members, a magnetron 13 which is a microwave generating portion for generating microwave, a steam generating portion 15 for generating stream in the heating chamber 11, and a detachable water supply tank 17 connected to a water supply path led to the steam generating portion 15.

The heating chamber 11 is formed in the inside of a body casing 10 shaped like a box having an opened front portion.

An open/close door 19 having a transparent window 19*a* for opening/closing a subject removal port of the heating chamber 11 is provided in a front surface of the body casing 10. A lower end of the open/close door 19 is connected to a lower edge of the body casing 10 by hinges, so that the open/close door 19 can be opened/closed in such a manner that an upper end of the open/close door 19 is moved back and forth with the lower end of the open/close door 19 as a center of rotation. A predetermined heat-insulating space is formed between walls of the heating chamber 11 and the body casing 10. As occasion demands, this space is filled with a heat-insulating material.

The magnetron 13 is disposed in a space under the heating chamber 11. A stirrer blade 21 is provided in a position where the stirrer blade 21 can receive microwave generated by the magnetron 13. When microwave generated by the magnetron 13 is applied to the stirrer blade 21 driven to rotate, the microwave is supplied into the heating chamber 11 while stirred by the stirrer blade 21. Although the description has been made on the case where the magnetron 13 and the stirrer blade 21 are provided in the bottom of the heating chamber 11, the invention is not limited thereto. For example, the magnetron 13 and the stirrer blade 21 may be provided in an upper or side surface of the heating chamber 11. Or a turntable may be provided instead of the stirrer blade 21 so that the subject side can be rotated.

The steam generating portion 15 has an evaporation pan 23 having a water reservoir cavity for generating steam by heating. Though not shown, an evaporation pan heating heater and a reflecting plate nearly U-shaped in section for reflecting radiation heat of the heater toward the evaporation pan 23 are provided below the evaporation pan 23. For example, the evaporation pan 23 is provided as a slender plate made of stainless steel. The evaporation pan 23 is disposed in the bottom of the heating chamber 11 on an inner side opposite to the subject removal port so that the lengthwise direction of the evaporation pan 23 goes along a partition plate 24. The evaporation pan 23 is provided so as to be out of the detection range in temperature detecting scanning of an infrared sensor not shown. Incidentally, a glass tube heater, a sheathed heater, a plate heater or the like may be used as the evaporation pan heating heater.

Figures 3A, 3B, 3C:
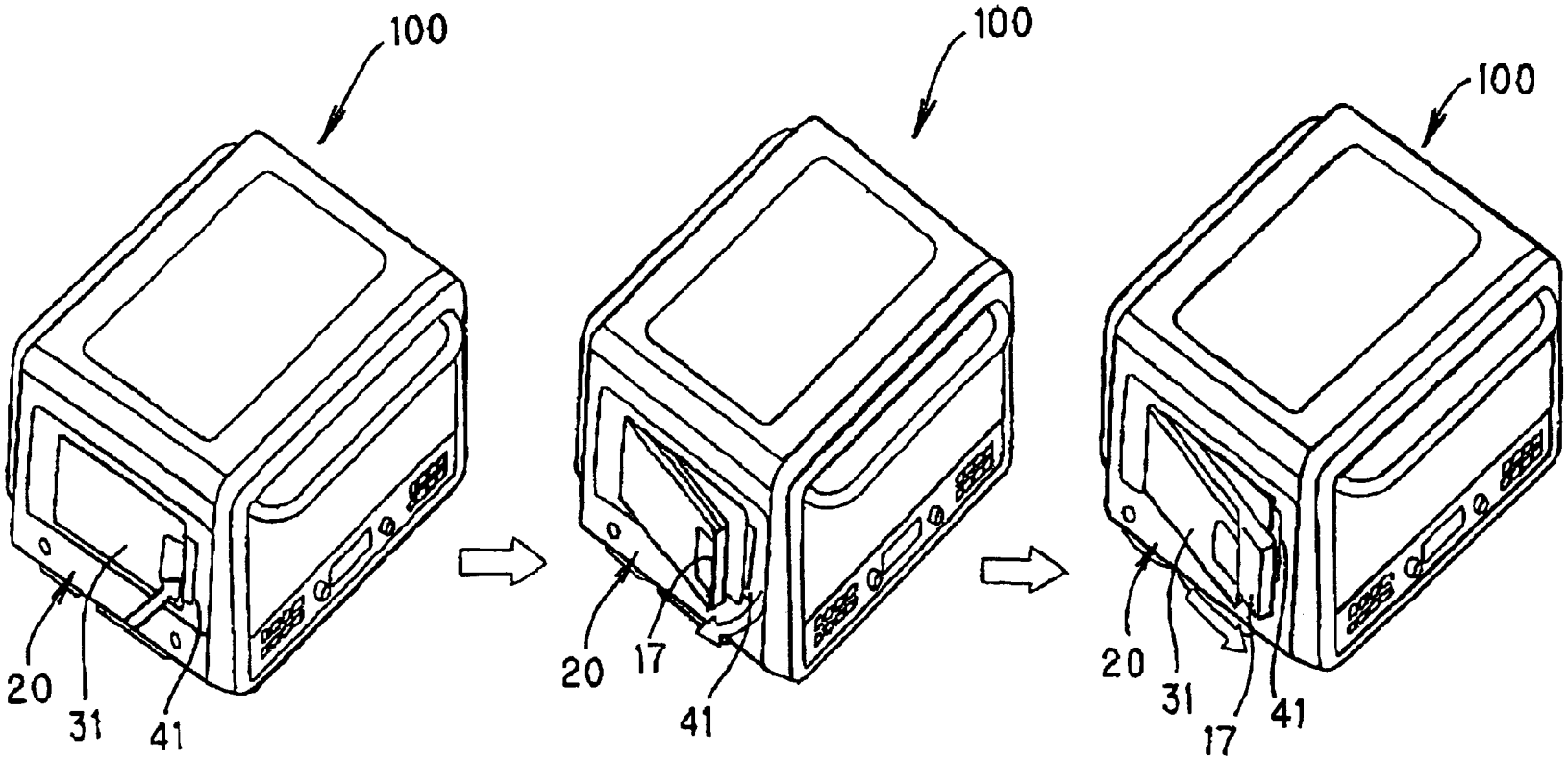
FIG. 3A to FIG. 3C are explanatory views showing a procedure for detaching a water supply tank from the microwave heating apparatus.

FIG. 3A to FIG. 3C show a procedure for removing the water supply tank 17 from the microwave heating apparatus 100. When a push button 41 provided on the front side of a side surface of the microwave heating apparatus 100 is pushed down inward the microwave heating apparatus 100 as shown in FIG. 3A, a tank casing door member 31 with the water supply tank 17 put therein is opened outward from the side surface of the microwave heating apparatus 100 as shown in FIG. 3B. When the water supply tank 17 is then pulled out toward the front side of the microwave heating apparatus 100 as shown in FIG. 3C, the water supply tank 17 can be removed.

The water supply tank 17 can be stored by a procedure reverse to the aforementioned procedure as follows. That is, in the condition that the tank casing door member 31 is opened, the water supply tank 17 is slid and inserted into the tank casing door member 31 so that the water supply tank 17 goes deep. When the tank casing door member 31 is then pushed back inward the microwave heating apparatus 100, the tank casing door member 31 is locked in a closed state by an operation member 35.

Next, the structure of the water supply tank unit 20 for disposing the water supply tank 17 attachable/detachable to/from the microwave heating apparatus 100 will be described.

Figure 4:
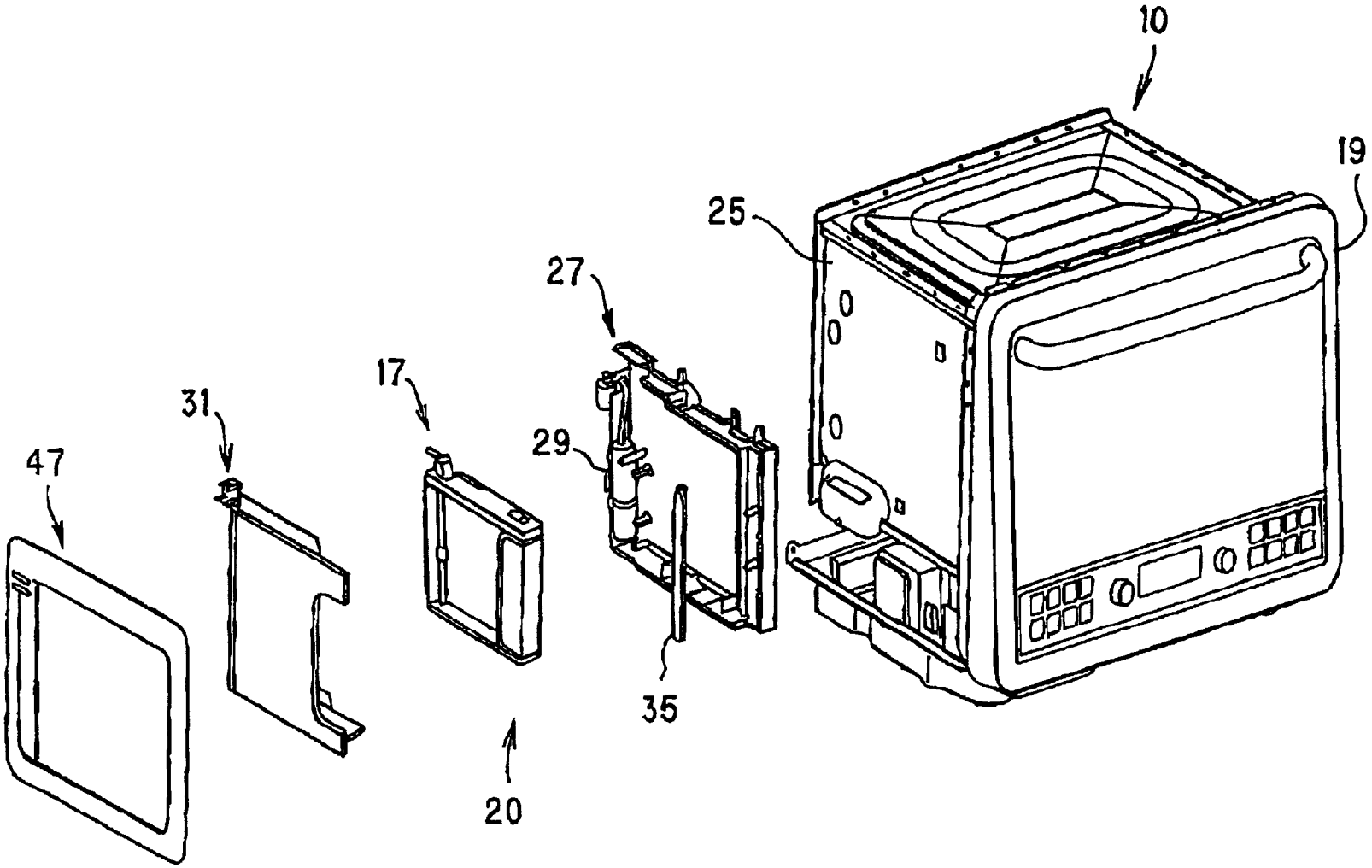
FIG. 4 is an exploded perspective view showing a configuration in which the water supply tank is arranged on a side of the microwave heating apparatus.
Figure 5A:
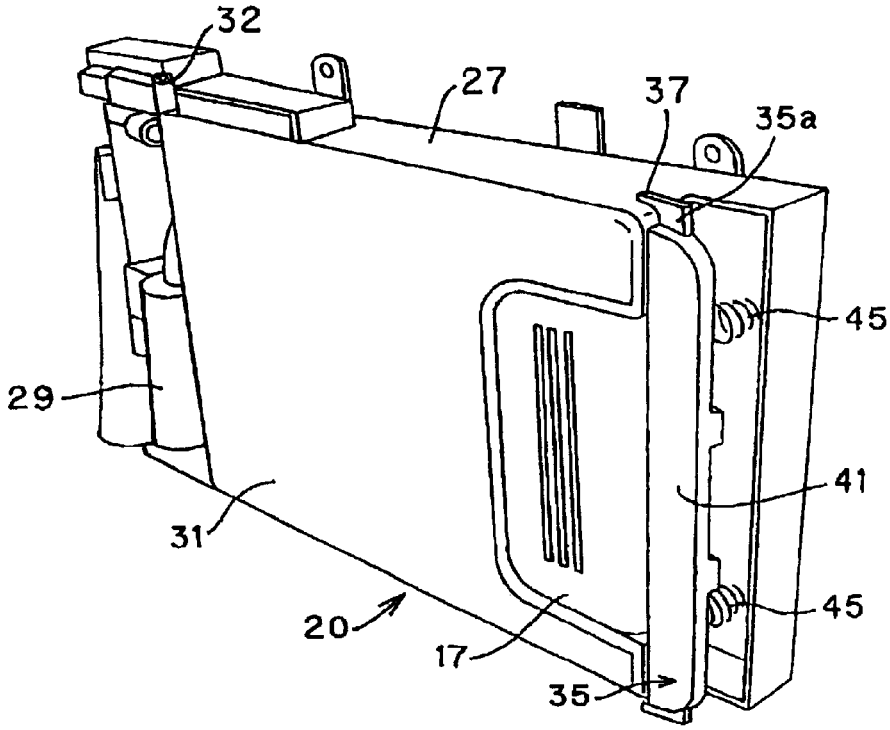
FIG. 5A and FIG. 5B are perspective views showing opened and closed states of a water supply tank unit.
Figure 5B:
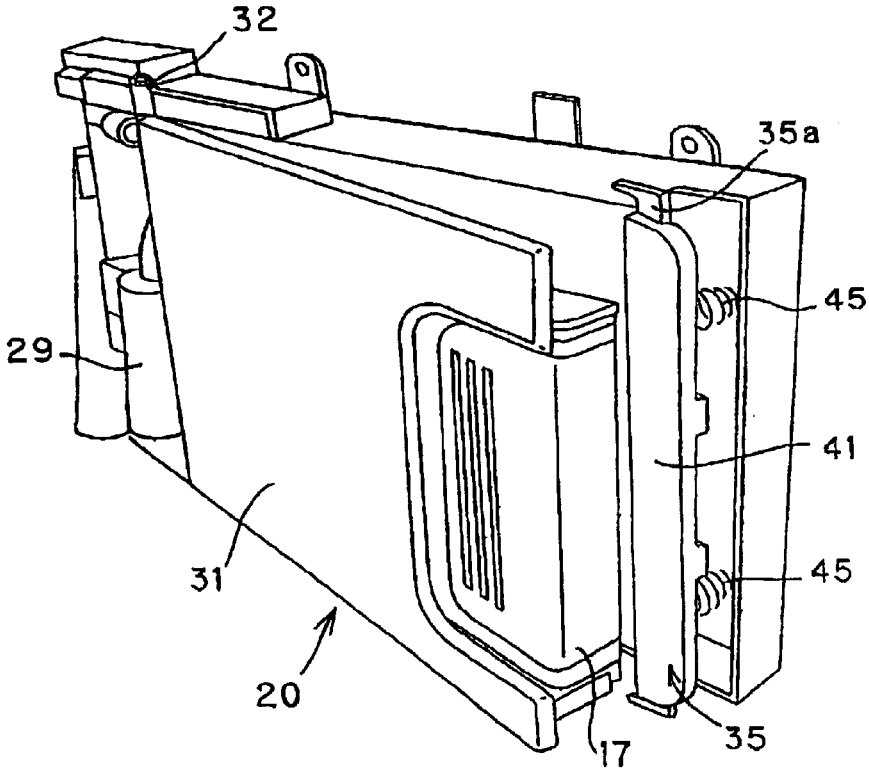
Figure 6:
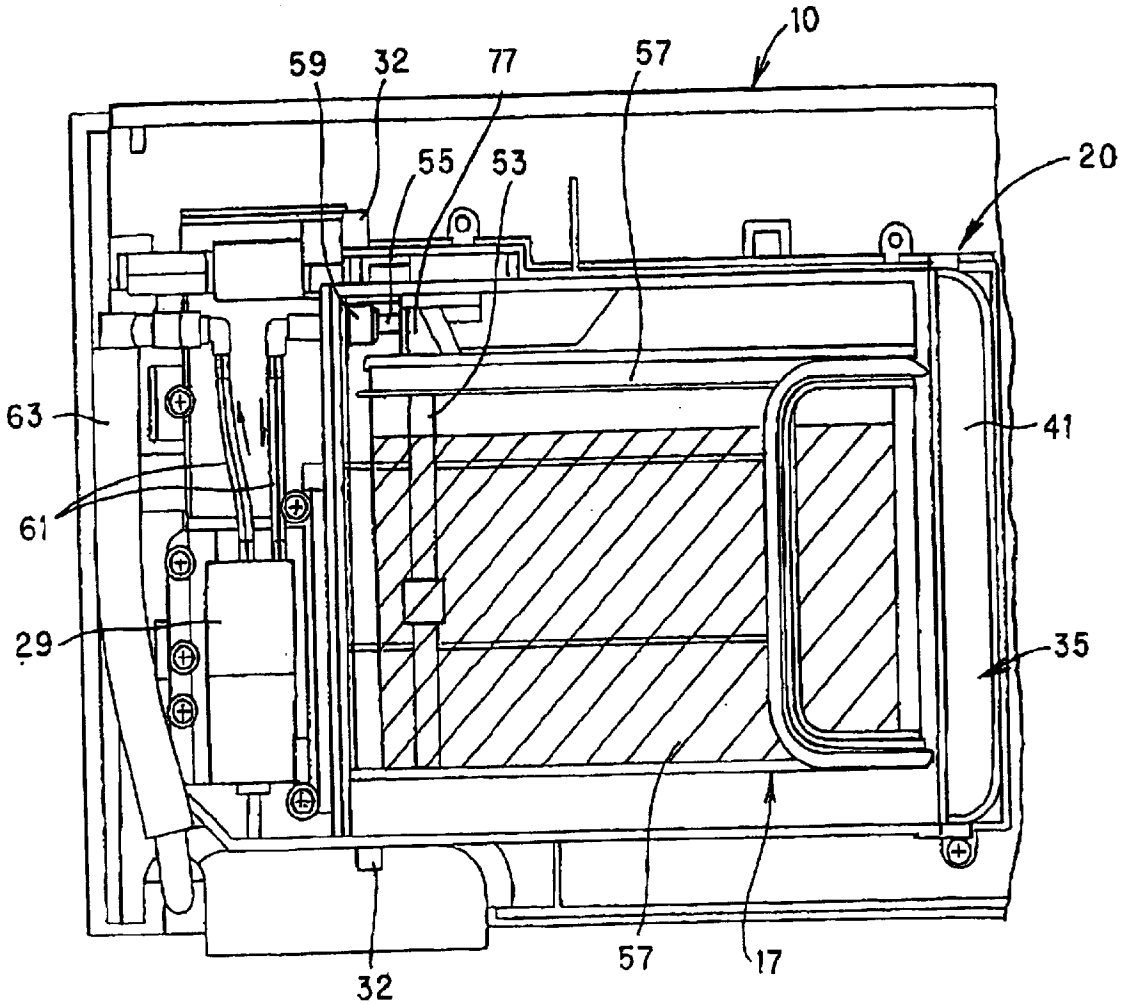
FIG. 6 is a front view of the water supply tank unit.

FIG. 4 is an exploded perspective view showing the water supply tank unit 20 for disposing the water supply tank on a side of the microwave heating apparatus. FIG. 5A and FIG. 5B are perspective views showing opened and closed states of the water supply tank unit 20. FIG. 6 is a front view showing the water supply tank unit 20.

As shown in FIG. 4, a side heat-insulating plate 25 is provided fixedly on a side of the microwave heating apparatus 100 with separation of a predetermined space from a side wall plate inside the heating chamber outward the microwave heating apparatus 100. A tank casing body 27 as a unit body is provided on the side heat-insulating plate 25 with interposition of a predetermined space between the tank casing body 27 and the side heat-insulating plate 25.

As shown in FIG. 5A and FIG. 5B, a water feed pump 29 is attached to the tank casing body 27. One end of the tank casing door member 31 as the open/close member is pivotally supported so as to be opened/closed freely with the support shaft 32 as a center of rotation. The water supply tank 17 is stored between the tank casing body 27 and the tank casing door member 31 while put in the tank casing door member 31.

Incidentally, the water supply tank 17 is shaped like a flattened rectangular parallelepiped. As shown in FIG. 6, the water supply tank 17 has a tank body 51, and a tank cover 57 which is provided with a water intake pipe 53 and a water supply port 55 fixed thereto and which can be attached/detached to/from the tank body 51.

When the water supply tank 17 is inserted into the tank casing door member 31, the water supply port 55 is connected to a water intake port 59 of the tank casing door member 31. In this state, the water feed pump 29 sucks water from the tank body 51 through the water intake pipe 53 and feeds the water into a feed hose 63 through a tube 61. As a result, the water is fed into the evaporation pan 23 (see FIG. 2) provided at a terminal of the feed hose 63.

Figure 7:
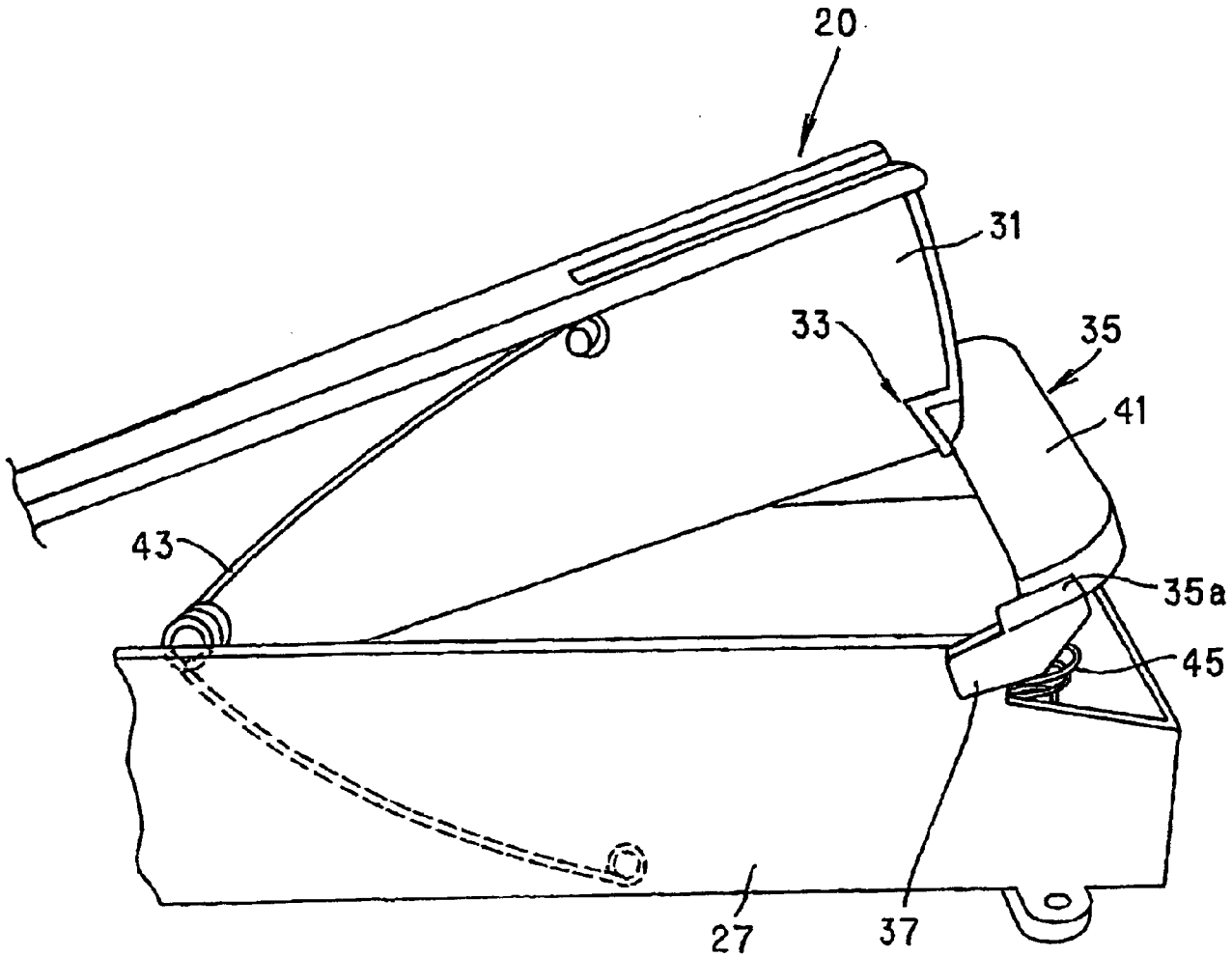
FIG. 7 is a perspective view showing part of the water supply tank unit for explaining the water supply tank unit and an operation member.

FIG. 7 shows an engagement portion between the tank casing body 27 and the tank casing door member 31. As shown in FIG. 7, a lock portion 33 for locking the tank casing door member 31 on the tank casing body 27 is provided on a side of the tank casing door portion 31 opposite to the support shaft 32.

An operation member 35 engaged with the tank casing door member 31 is mounted on the tank casing body 27. The operation member 35 is supported to upper and lower portions of the tank casing body 27 so that the operation member 35 can be rotated by a pair of support arms 37 formed at opposite ends of the operation member 35. A torsion coiled spring 43 is provided between the tank casing body 27 and the tank casing door member 31 for biasing the tank casing door member 31 in a direction of departing from the tank casing body 27 so that the tank casing door member 31 can be ejected outward the microwave heating apparatus 100 when the locked state of the lock portion 33 by the operation member 35 is unlocked.

Figure 8:
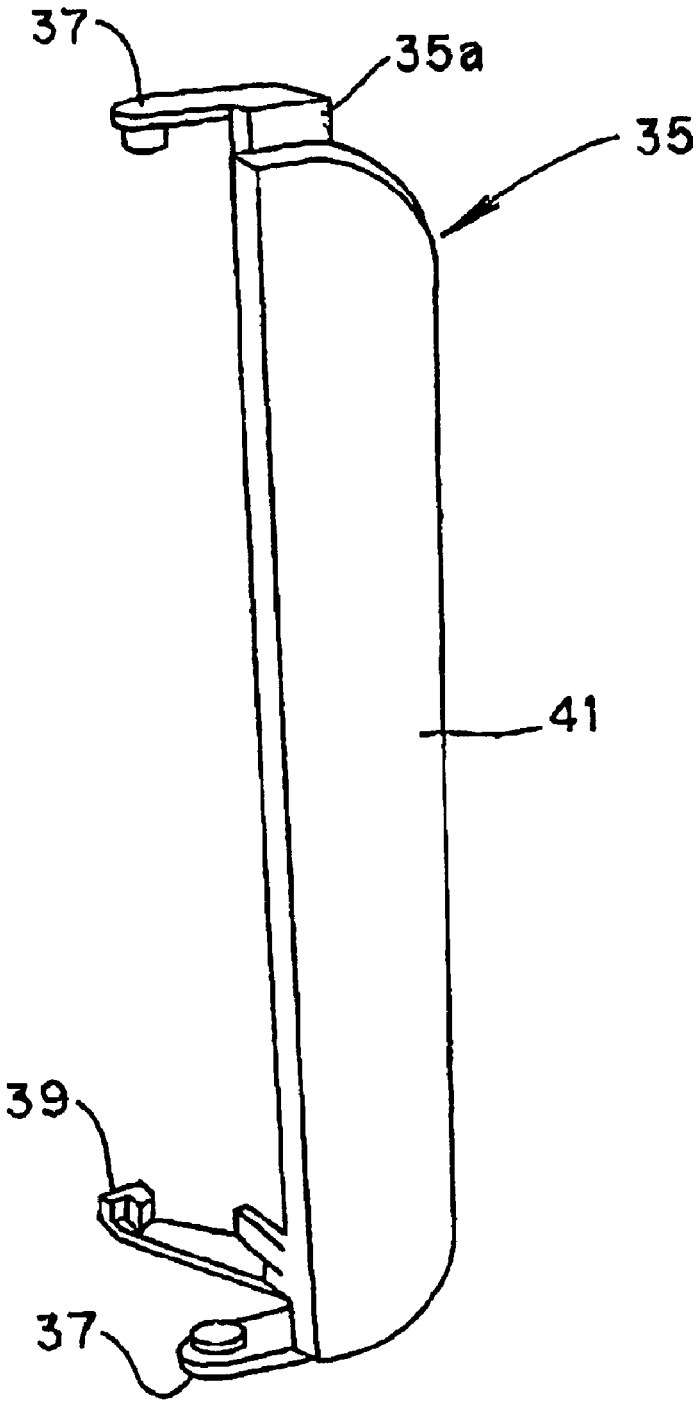
FIG. 8 is a perspective view showing the shape of the operation member of the water supply tank unit.
Figure 9:
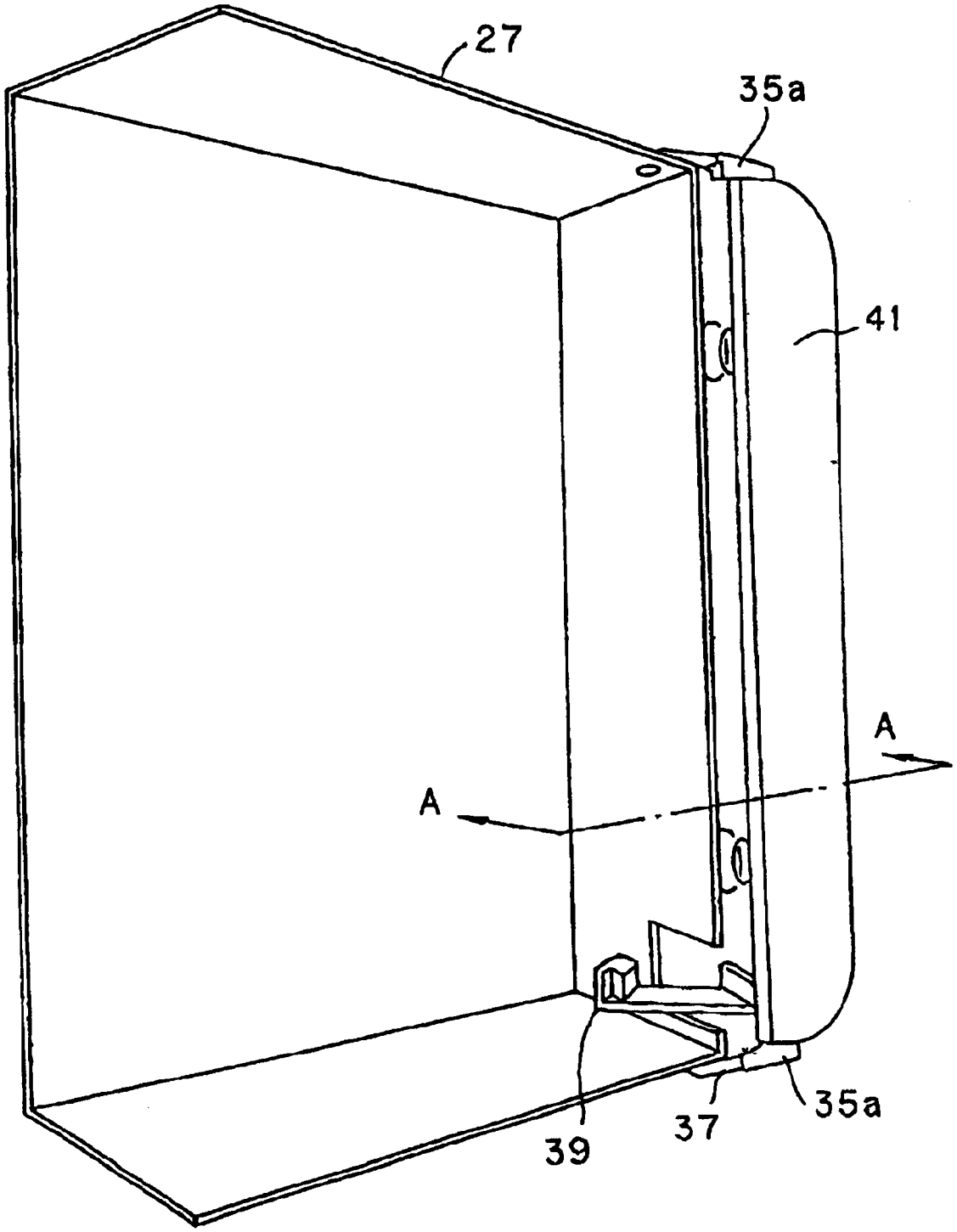
FIG. 9 is a perspective view showing a mounting structure of the operation member of the water supply tank unit.

FIG. 8 is a perspective view showing the shape of the operation member 35. FIG. 9 is a perspective view showing an attachment structure of the operation member 35.

As shown in FIG. 8 and FIG. 9, the operation member 35 has a pair of support arms 37 pivotally supported to the tank casing body 27 so as to be rotatable, an engagement portion 39 engaged with the lock portion 33 of the tank casing door member 31 to keep the tank casing door member 31 locked on the tank casing body 27, and a push button 41 for unlocking the locked state due to the engagement between the lock portion 33 and the engagement portion 39 by a pushing-down operation.

A plurality of barrel-shaped coiled springs 45 are attached onto the back of the push button 41 of the operation member 35 so as be suspended between the push button 41 and the tank casing body 27. The barrel-shaped coiled springs 45 bias the push button 41 in a direction reverse to the pushing-down direction, that is, in a direction against the pushing-down of the push button 41.

Figure 10:
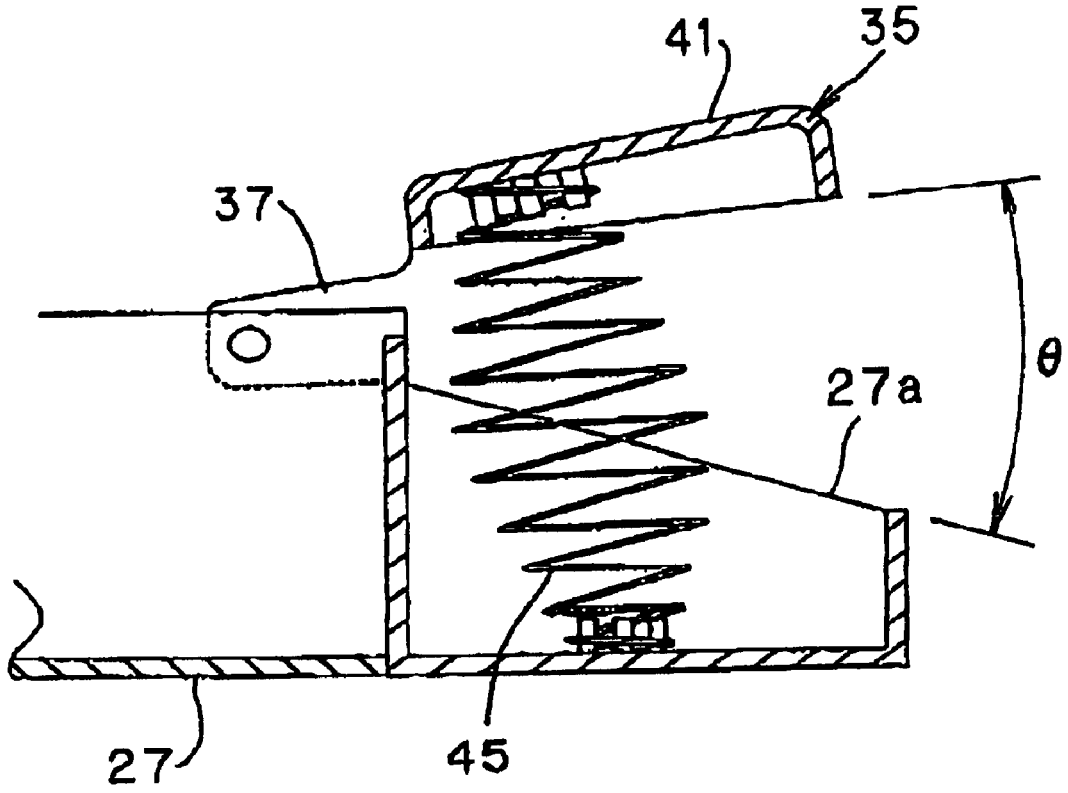
FIG. 10 is a sectional view, taken along the line A—A in FIG. 9, of the water supply tank unit for explaining a push button arrangement structure of the operation member.
Figure 11:
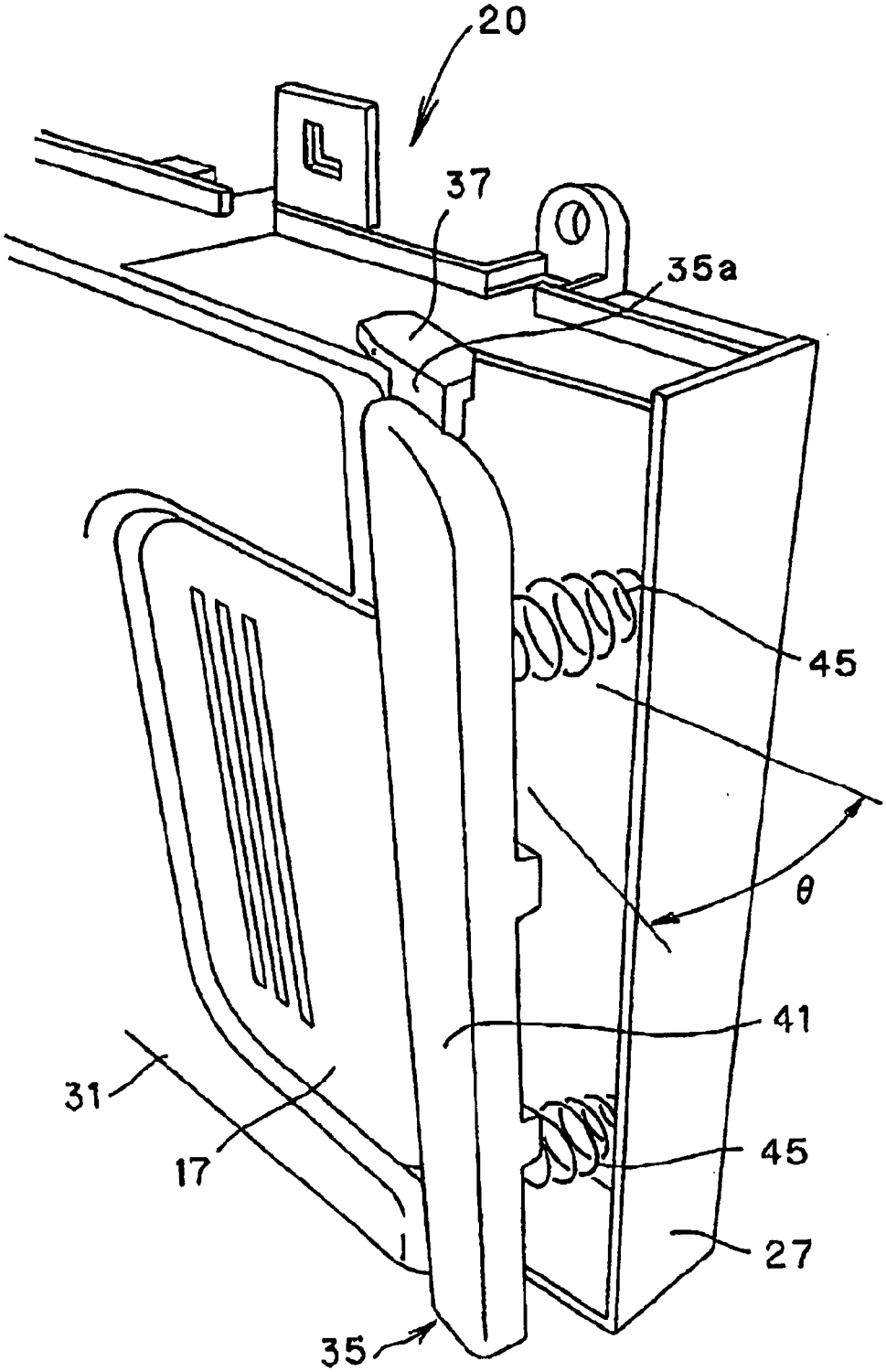
FIG. 11 is a perspective view showing part of the storage unit for explaining the push button arrangement structure of the operation member.

FIG. 10 is a sectional view taken along the line A—A in FIG. 9.

Each of the barrel-shaped coiled springs 45 is formed so that the coil diameter of the spring 45 is largest at its center and tapers toward opposite end portions to thereby prevent the spring 45 from being buckled by the pushing-down of the push button 41.

The way of engaging the tank casing door member 31 with the operation member 35 will be described below in detail.

Figure 20A:
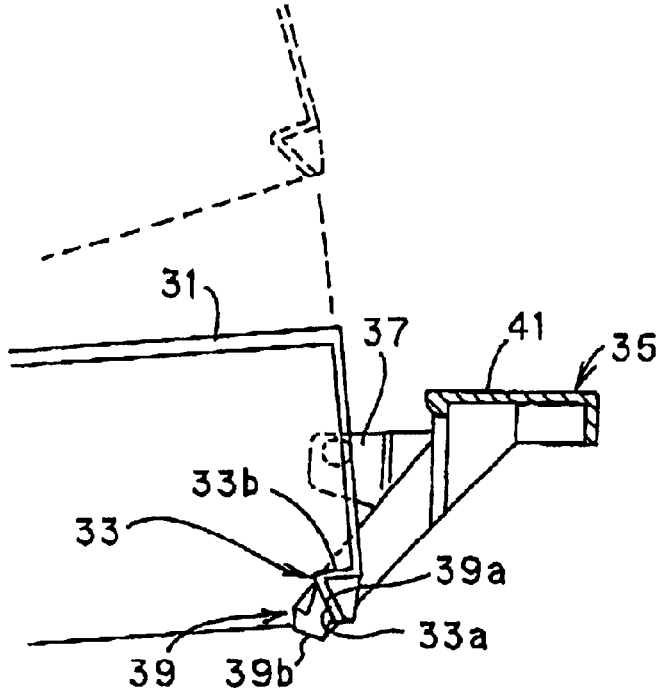
FIG. 20A to FIG. 20C are sectional views for explaining the way of engaging the operation member to a tank casing door member.
Figure 20B:
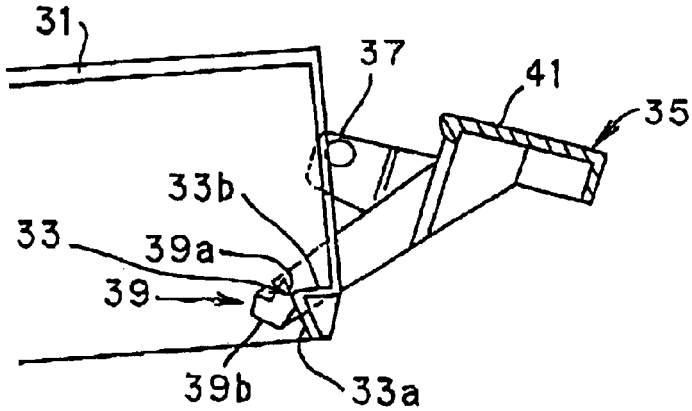
Figure 20C:
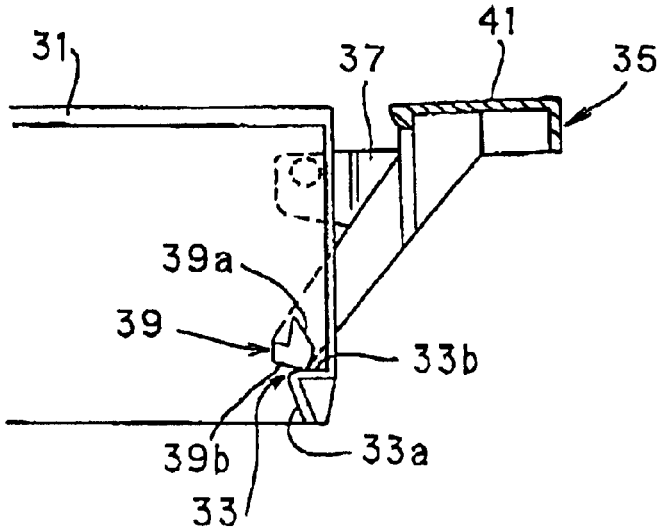

FIG. 20A to FIG. 20C show the engagement of respective members stepwise. When the tank casing door member 31 in an opened state is first pushed into the tank casing body side as shown in FIG. 20A, an abutting surface 33*a* formed in the lock portion 33 of the tank casing door member 31 abuts on an abutting surface 39*a* formed in the engagement portion 39 of the operation member 35 as shown in FIG. 20B. When the tank casing door member 31 is further pushed into the tank casing body side, the abutting surfaces 39*a* and 33*a* slide on each other to rotate the operation member 35 in the pushing-down direction against the biasing force of the barrel-shaped coiled springs 45 to thereby push down the push button 41 more deeply than an outer surface of a decoration panel 47.

That is, each of the abutting surfaces 33*a* and 39*a* has a length sufficient to slide continuously until the push button 41 is pushed down more deeply than the outer surface of the decoration panel 47.

When sliding of the abutting surfaces 33*a* and 39*a* is then completed, the operation member 35 is rotated in a reverse direction by the biasing force of the barrel-shaped coiled springs 45 as shown in FIG. 20. As a result, an engagement surface 33*b* formed in the lock portion 33 is engaged with an engagement surface 39*b* formed in the engagement portion 39, so that the tank casing door member 31 is kept closed, that is, locked.

Next, the detailed structure and operation of the water supply tank unit 20 will be described.

The structure in which the water supply tank 17 clicks when attached/detached to/from a predetermined retention position in the tank casing door member 31 will be described first.

Figure 12:
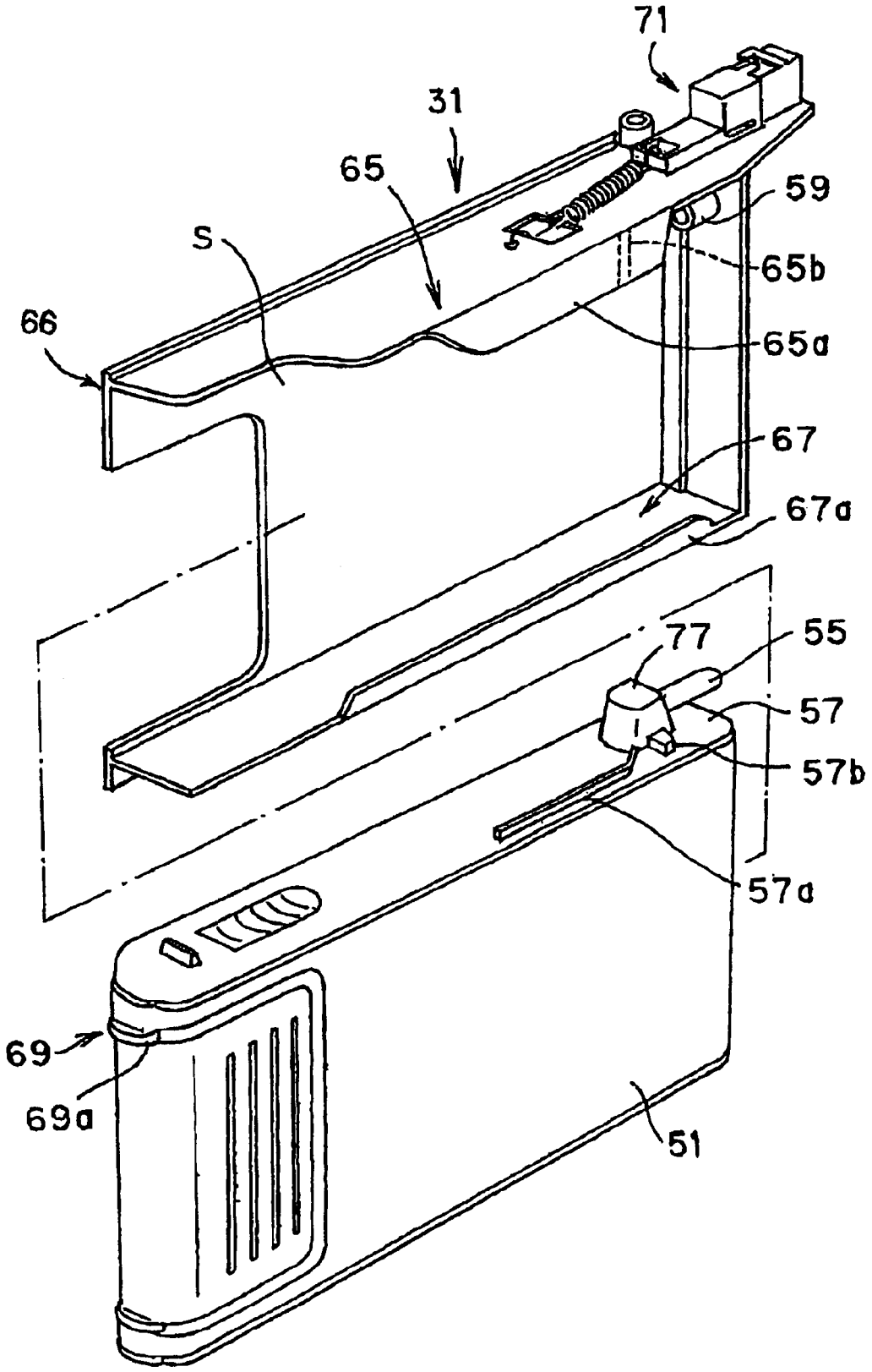
FIG. 12 is a schematic exploded perspective view of the water supply tank unit for explaining the detailed structure of the water supply tank unit.
Figure 13:
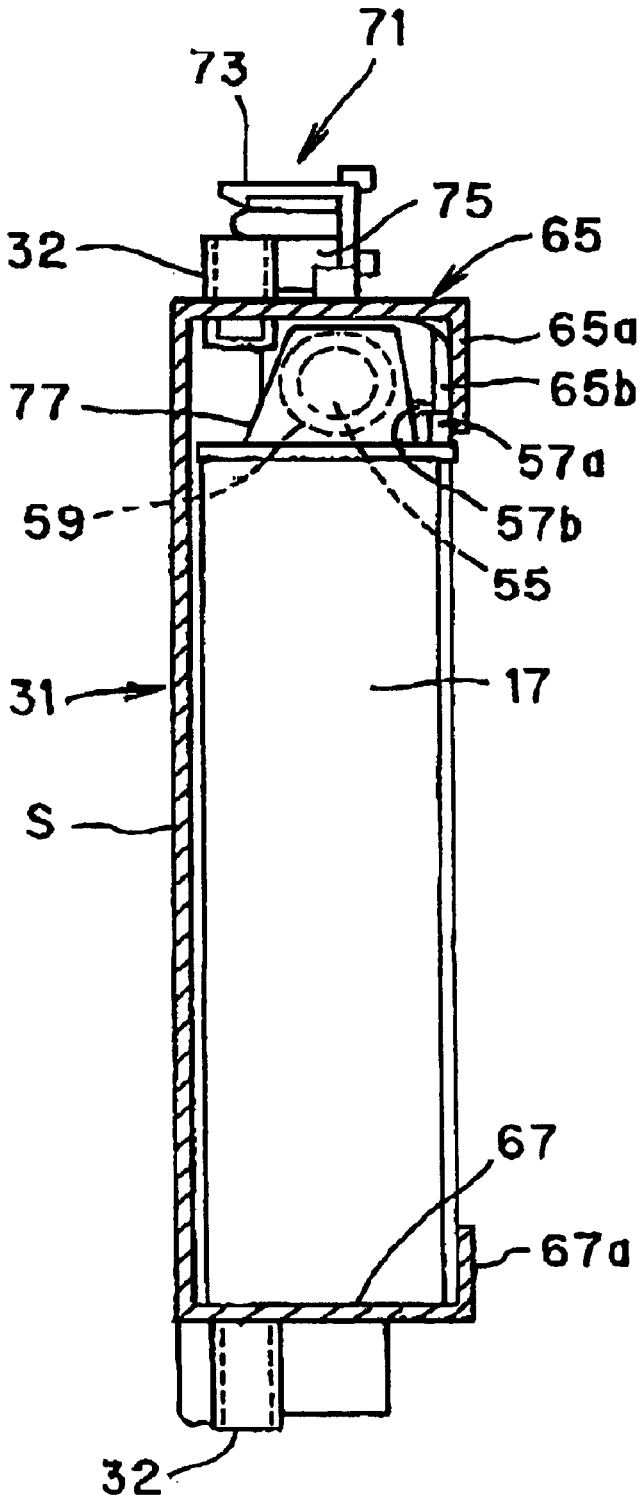
FIG. 13 is a sectional view showing the structure of the water supply tank unit.

FIG. 12 is a schematic exploded perspective view of the water supply tank unit for explaining the detailed structure of the water supply tank unit. FIG. 13 is a sectional view showing the structure of the water supply tank unit.

As shown in FIG. 12 and FIG. 13, the tank casing door member 31 into which the water supply tank unit 17 is inserted and attached has a top portion 65 and a bottom portion 67 for forming a storage space S. The top and bottom portions 65 and 67 have guide walls 65*a* and 67*a* respectively. The guide walls 65*a* and 67*a* are provided along the direction of attaching the water supply tank 17. The guide walls 65*a* and 67*a* abut on opposite side surfaces of the water supply tank 17 so as to guide the attaching/detaching operation of the water supply tank 17.

The tank cover 57 of the water supply tank 17 has a rib 57*a* provided along the direction of attaching the water supply tank 17. The rib 57*a* abuts on the guide wall 65*a* of the tank casing door member 31 and guides the water supply tank 17 to the predetermined retention position in the storage space S.

The guide wall 65*a* of the tank casing door member 31 and the tank cover 57 of the water supply tank 17 have protrusions 65*b* and 57*b* respectively. Each of the protrusions 65*b* and 57*b* is shaped like a triangle in horizontal section. The protrusions 65*b* and 57*b* climb over each other and are locked to each other in a process of attaching/detaching the water supply tank 17 to/from the predetermined retention position in the storage space S.

Incidentally, when the water supply tank 17 is attached into the tank casing door member 31, the water supply tank 17 serves as a member for reinforcing the tank casing door member 31. Even a portion of the tank casing door member 31 (especially, an end portion 66) that can hardly be closed because the tank casing door member 31 per se is low in rigidity can be closed easily when the door is pushed.

Figure 14A:
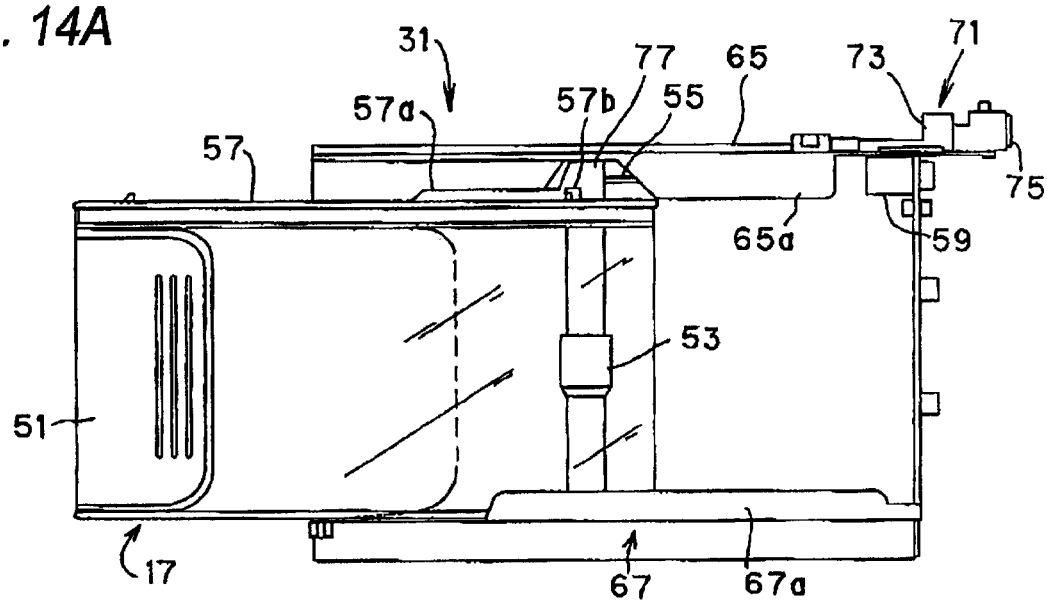
FIG. 14A and FIG. 14B are explanatory views showing a state in which the water supply tank is inserted into the tank casing door member.
Figure 14B:
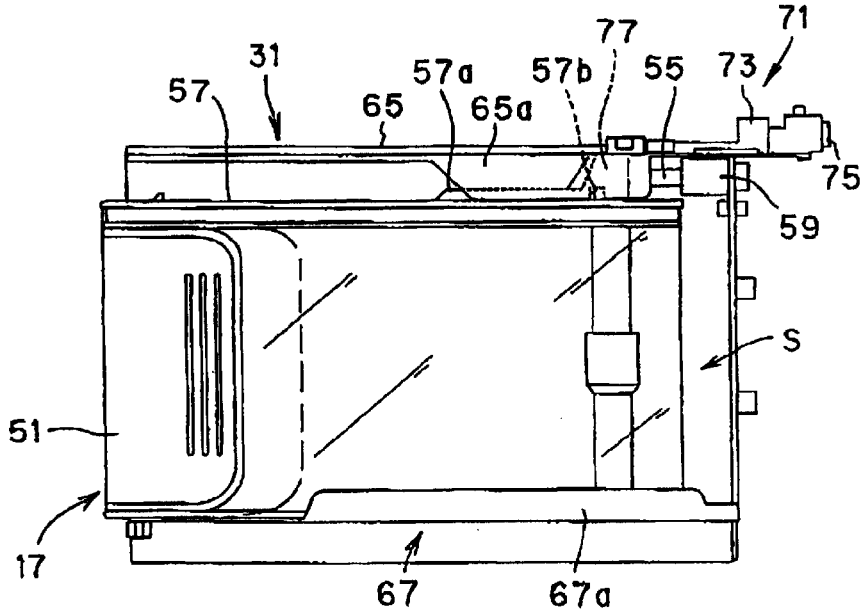

FIG. 14A and FIG. 14B show a state in which the water supply tank 17 is inserted into the storage space S between guide walls 65*a* and 67*a* of the tank casing door member 31. In the water supply tank unit 20 configured as described above, the water supply tank 17 is first put on the bottom portion 67 as shown in FIG. 14A and then slid toward the water intake port 59 as shown in FIG. 14B. On this occasion, the guide walls 65*a* and 67*a* are distorted by elastic deformation to clamp the water supply tank 17 in the storage space S to thereby limit the position of the water supply tank 17 in a horizontal plane perpendicular to the direction of insertion of the water supply tank 17.

Figure 15A:
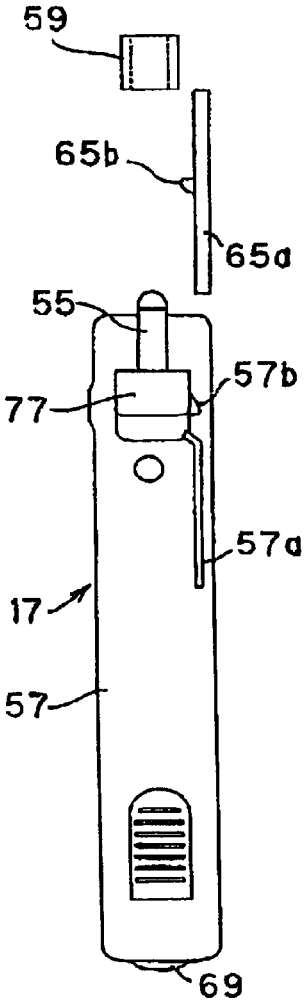
FIG. 15A to FIG. 15C are explanatory views showing positional relations among the water supply tank, a guide wall and a water intake port when the water supply tank is attached.
Figure 15B:
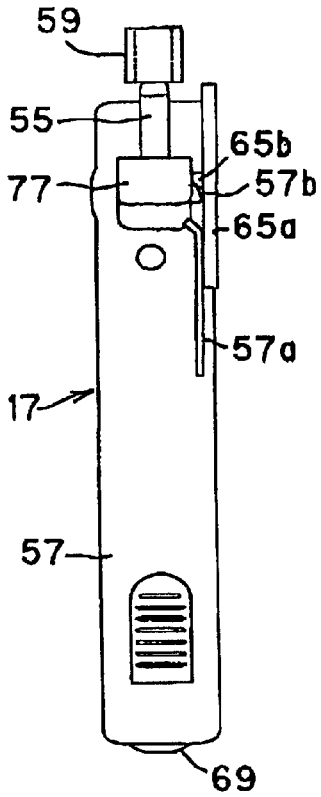
Figure 15C:
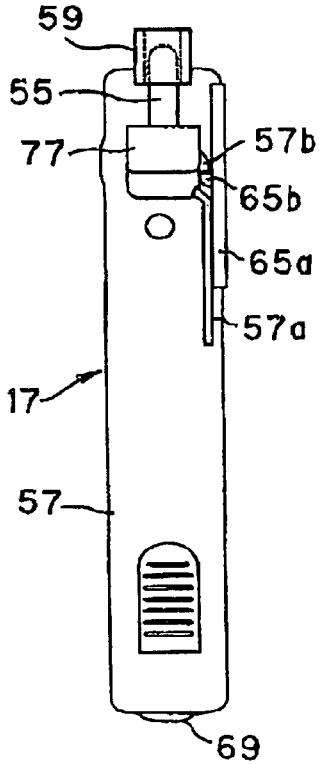

The attaching operation of the water supply tank 17 will be described in more detail. FIG. 15A to FIG. 15C are explanatory views showing positional relations among the water supply tank 17, the guide wall 65*a* and the water intake port 59 at the time of attaching the water supply tank 17.

When the water supply tank 17 put on the bottom portion 67 is inserted as shown in FIG. 15A, the inserting operation is once interrupted because of increase in insertion resistance in a position where the protrusion 57*b* provided on the tank cover 57 abuts on the protrusion 65*b* provided on the guide wall 65*a* as shown in FIG. 15B. Incidentally, on this occasion, the guide wall 65*a* abuts on the rib 57*a* of the tank cover 57 to perform positioning in the horizontal plane. When the water supply tank 17 once stopped in this manner is further pushed toward the water intake port 59, the protrusions 57*b* and 65*b* climb over each other according to the elastic deformation of the guide wall 65*a* and flat rear end surfaces of the protrusions 57*b* and 65*b* are engaged with each other so that the protrusions 57*b* and 65*b* cannot move back, as shown in FIG. 15C. When the protrusions 57*b* and 65*b* climb over each other, that is, when a state shown in FIG. 15B changes to a state shown in FIG. 15C, a click sense is generated so that the water supply tank 17 is attached to the predetermined retention position steadily.

Next, a water supply tank detection unit for detecting whether the water supply tank 17 inserted is attached to the predetermined retention position or not will be described.

Figure 16:
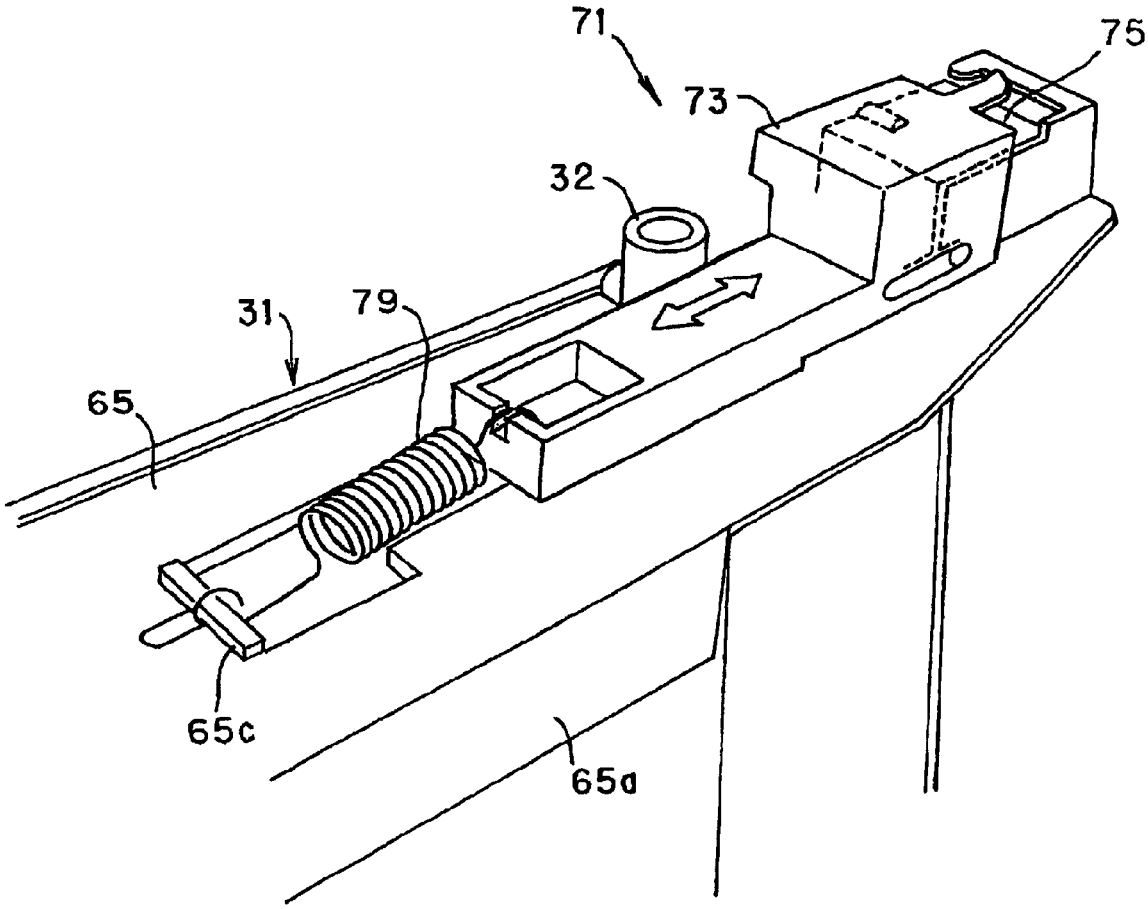
FIG. 16 is an enlarged perspective view showing the external appearance of a water supply tank detection unit.
Figure 17:
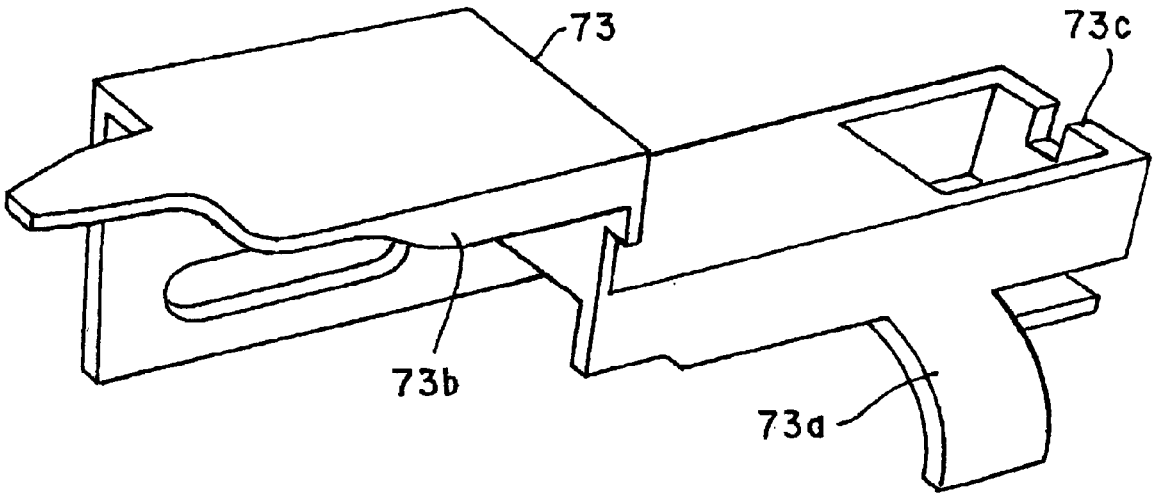
FIG. 17 is a perspective view showing the shape of a driven member as a constituent member of the water supply tank detection unit.
Figure 18A:
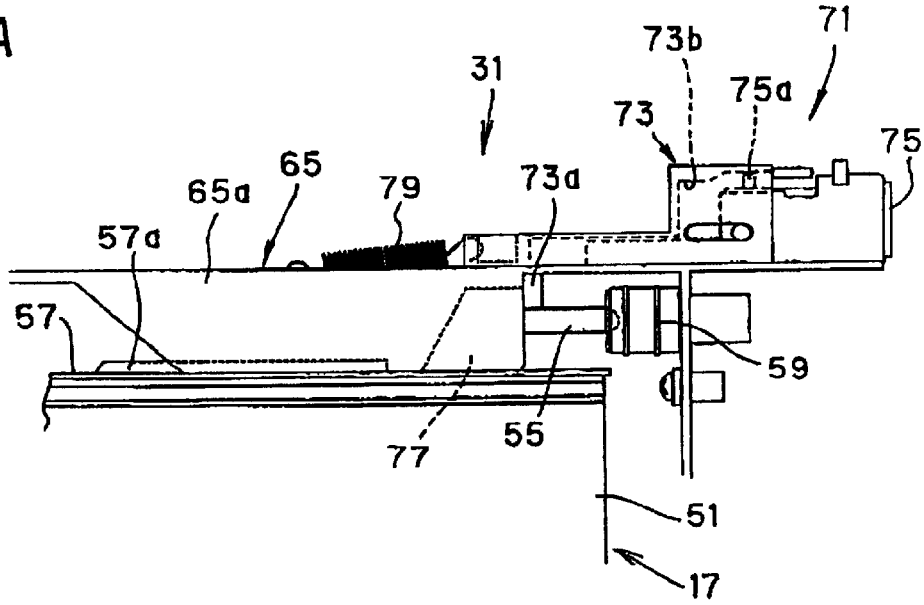
FIG. 18A and FIG. 18B are explanatory views showing the operation of the water supply tank detection unit.
Figure 18B:
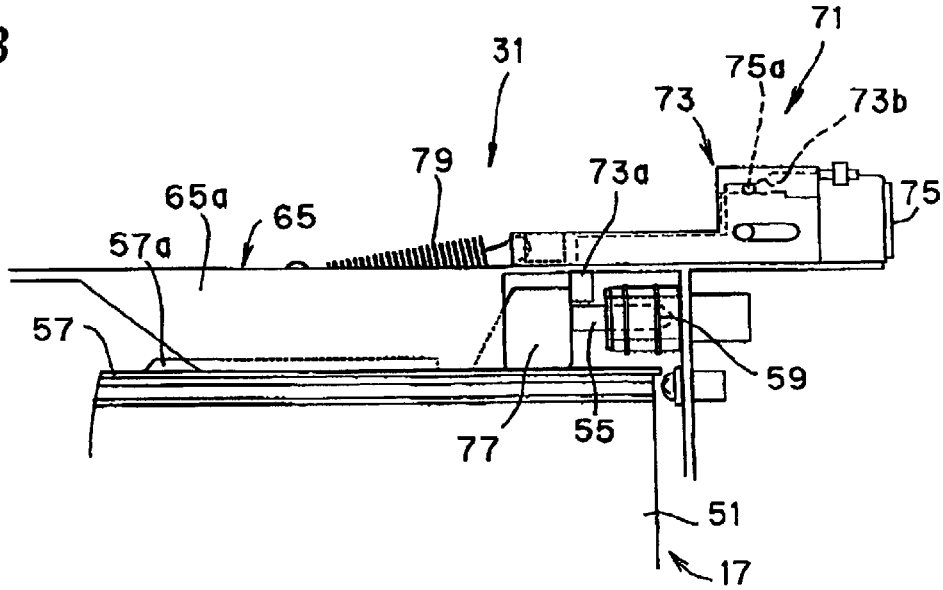

FIG. 16 is an enlarged perspective view showing the external appearance of the water supply tank detection unit. FIG. 17 is a perspective view showing the shape of a driven member as a constituent member of the water supply tank detection unit. FIG. 18A and FIG. 18B are explanatory views showing the operation of the water supply tank detection unit.

As shown in FIG. 16, the water supply tank detection unit 71 for detecting attachment/detachment of the water supply tank 17 is provided on an upper portion of the tank casing door member 31.

The water supply tank detection unit 71 has a driven member 73 provided so as to be slidable along the direction of attaching the water supply tank 17, and a switch 75 operated by the driven member 73 for changing a state reversibly according to the sliding of the driven member 73. One end of a tension spring 79 is connected to an upper fixing portion 65*c* of the tank casing door member 31. The other end of the tension spring 79 is connected to a rear end of the driven member 73. The driven member 73 is pulled backward in the direction of attaching the water supply tank 17 by the biasing force of the tension spring 79.

As shown in FIG. 17, the driven member 73 has a lock piece 73*a* protruded toward the storage space S side, a push piece 73*b* having a lower slide surface with a thickness increasing downward from a front end to a base, and a coil lock piece 73*c* provided at an end portion opposite to the push piece 73*b* for mounting the tension spring 79.

The push piece 73*b* of the driven member 73 is provided so that the switch 75 is covered with the push piece 73*b*. Even if water leakage occurs, the push piece 73*b* prevents the switch 75 from being submerged with water.

The operation of the switch 75 due to the driven member 73 will be described with reference to FIG. 18A and FIG. 18B. As shown in FIG. 18A, before the water supply tank 17 clicks in the aforementioned manner because the protrusions 57*b* and 65*b* climb over each other, the lock piece 73*a* is pulled in a direction reverse to the direction of attaching the water supply tank 17 by the tension spring 79. In this state, a push portion 75*a* of the switch 75 is still located in a rise position, so that the switch 75 is off.

When the water supply tank 17 in this state is then pushed in the attaching direction so that the protrusions 57*b* and 65*b* climb over each other, a protrusion 77 provided with the water intake portion 55 of the water supply tank 17 attached into the storage space S presses the lock piece 73*a* to move the driven member 73 to the switch 75 side, as shown in FIG. 18B. Because the driven member 73 is moved to the switch 75 side by the water supply tank 17, the push portion 75*a* of the switch 75 is pushed down according to the thickness change of the lower slide surface of the push piece 73*b* to thereby turn the switch 75 on.

When the water supply tank 17 is pulled out of the storage space S of the tank casing door member 31, the driven member 73 is moved backward in the direction of attaching the water supply tank 17 by the tension spring 79 to cancel the pushing of the push portion 75*a* of the switch 75 due to the push piece 73*b* to thereby turn the switch 75 off. When the switch 75 is off, the heating control of the microwave heating apparatus 100 is limited on the basis of a decision that the water supply tank 17 is not connected.

In this manner, the water supply tank detection unit 71 can detect steadily whether the water supply tank 17 is attached to the predetermined retention position in the storage space S or not. When the water supply tank 17 is not attached or when connection of the water supply tank 17 to the water intake port 59 is not perfect, the water feed pump can be prevented from being operated. Accordingly, mixing of air bubbles in the water feed path and production of water drops can be prevented steadily.

Next, the structure for inserting the water supply tank 17 into the tank casing door member 31 steadily will be described.

Figure 19A:
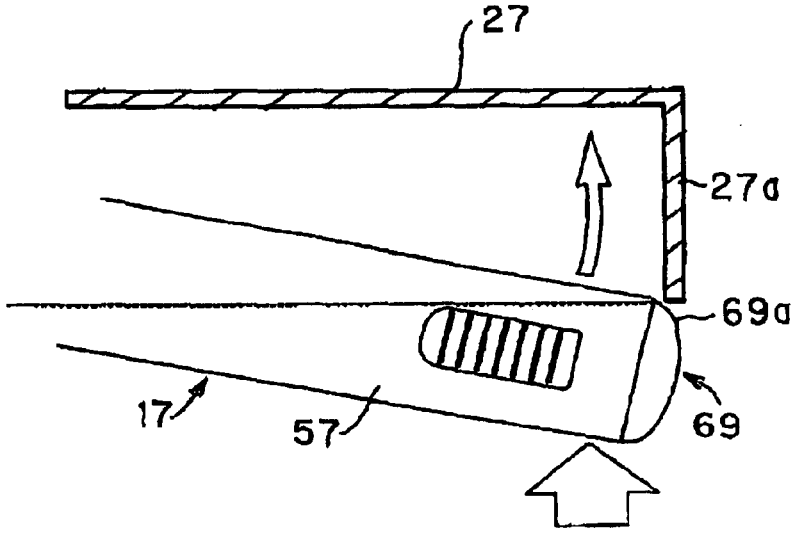
FIG. 19A to FIG. 19C are explanatory views showing a state in which the water supply tank is pushed into the tank casing body in the attachment direction.
Figure 19B:
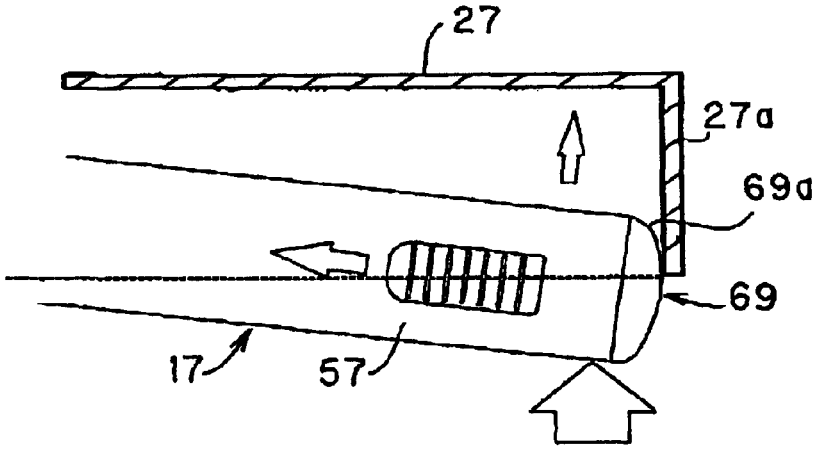
Figure 19C:
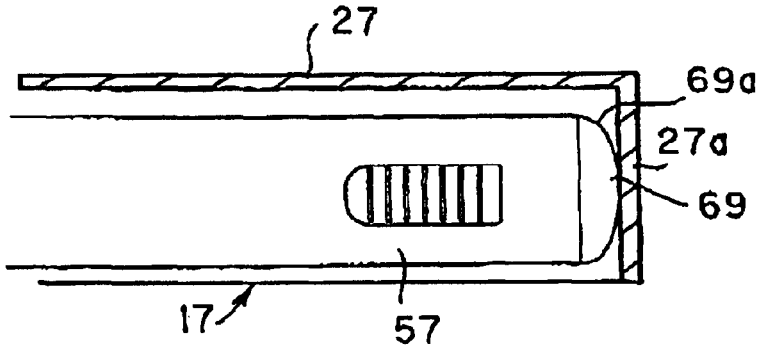

FIG. 19A to FIG. 19C are explanatory views showing a state in which the water supply tank is pushed toward the tank casing body in the attaching direction.

As shown in FIG. 19A to FIG. 19C, the water supply tank 17 has a pawl portion 69 provided at a rear end in the direction of attaching the water supply tank 17 into the tank casing door member 31 so as to extend in the direction of the width of the water supply tank 17. The pawl portion 69 has an inclined portion 69*a* formed so that a length of protrusion backward in the direction of attaching the water supply tank 17 into the tank casing door member 31 increases backward in the direction of pushing the tank casing door member 31 toward the tank casing body 27 in a state in which the water supply tank 17 is attached into the tank casing door member 31.

When the pawl portion 69 is formed at a rear end in the direction of attaching the water supply tank 17 in this manner, the water supply tank 17 can be pushed automatically in the attaching direction. That is, when the tank casing door member 31 with the water supply tank 17 put therein is pushed into the tank casing body 27 from an opened state as shown in FIG. 19A, the inclined portion 69*a* of the pawl portion 69 formed at the rear end of the water supply tank 17 abuts on a wall portion 27*a* of the tank casing body 27 as shown in FIG. 19B. As a result, the water supply tank 17 in the tank casing door member 31 is pushed forward in the attaching direction, so that the water supply tank 17 can be steadily attached to the predetermined retention portion in the tank casing door member 31 as shown in FIG. 19C.

Even in the case where attachment is insufficient, for example, because of shortage of the quantity of insertion of the water supply tank 17 into the tank casing door member 31, the water supply tank 17 is automatically inserted and positioned in the predetermined retention position when the tank casing door member 31 is pushed back toward the tank casing body 27. Accordingly, the water supply tank 17 can be prevented from being stored in the tank casing body 27 in a state in which connection of the water supply tank 17 to the water intake port 59 of the tank casing body 27 is insufficient water leakage from the water supply tank 17 can be prevented more steadily. In addition, because the water feed path can be connected steadily by a simple operation of inserting the water supply tank 17 into the tank casing door member 31 and pushing back the tank casing door member 31 toward the tank casing body 27, the handling property of the microwave heating apparatus 100 can be improved.

In the water supply tank unit 20 described above, because the protrusions 57*b* and 65*b* are provided so that the protrusions 57*b* and 65*b* climb over each other and are locked to each other the water supply tank 17 is attached/detached to/from the tank casing door member 31, the water supply tank 17 can be steadily attached into the tank casing door member 31 with a click sense due to the locking of the protrusions 57*b* and 65*b* to each other so that the attachment state of the water supply tank 17 can be checked easily. Accordingly, even in the case where it is difficult to store the water supply tank 17 and check the attachment of the water supply tank 17, for example, because of a structure in which the water supply tank 17 is stored in a narrow space in the microwave heating apparatus 100, the water supply port 55 of the water supply tank 17 can be steadily connected to the water intake port 59 on the microwave heating apparatus 100 side. Water can be supplied to the inside of the microwave heating apparatus 100 without water leakage, so that the moistening function of the microwave heating apparatus 100 can be effectuated well.

Furthermore, because the water supply tank 17 is inserted while guided into the predetermined retention position in the storage space S by the engagement of the guide wall 65*a* and the rib 57*a*, the water supply tank 17 can be attached stably. The water supply port 55 is prevented from being inserted obliquely with respect to the water intake port 59, so that connecting portions can be prevented from being damaged.

Furthermore, according to the water supply tank detection unit 71, the attached water supply tank 17 is detected by the switch 75 operated by the driven member 73 moved by the attachment of the water supply tank 17 into the tank casing door member 31. Accordingly, the state of attachment of the water supply tank 17 can be easily checked on the basis of the operating state of the switch 75.

Furthermore, when the tank casing door member 31 with the water supply tank 17 put therein is pushed toward the tank casing body 27, the inclined portion 69*a* of the pawl portion 69 of the water supply tank 17 abuts on the wall portion 27*a* of the tank casing body 27 so that the water supply tank 17 is pushed in the direction of attaching the water supply tank 17 into the tank casing door member 31 by the pushing force of the tank casing door member 31. Accordingly, the water supply tank 17 can be attached steadily.

Although the example has shown the case where the inclined portion 69*a* abutting on the wall portion 27*a* of the tank casing body 27 is formed on the pawl portion 69 side, configuration may be made so that the same inclined portion as described above is formed on the tank casing body 27 side.

According to the microwave heating apparatus 100 assembled in this manner, the water supply tank 17 is disposed so as to be attachable/detachable to/from the microwave heating apparatus 100. Hence, water can be exchanged easily so that sanitary water supply can be performed. Furthermore, because the water supply tank 17 is disposed in a side surface of the microwave heating apparatus 100, the water supply tank 17 exerts no influence on the heating operation carried out from the front side of the microwave heating apparatus 100. In addition, because the rotary shaft of the tank casing door member 31 is provided in the inner side of the microwave heating apparatus 100, the tank casing door member 31 can be opened on the front side. Accordingly, the water supply tank 17 can be attached/detached on the front side with good handling property.

Although the description has been made above on the case where the water supply tank 17 is disposed in one side surface of the microwave heating apparatus 100, the water supply tank 17 may be disposed in any place such as the other side surface, a top surface or a bottom surface. Also in this case, the water supply tank 17 can be attached/detached with good handling property by an operation of pulling out the water supply tank 17 outward the microwave heating apparatus 100 and then attaching/detaching the water supply tank 17 on the front side.

In addition, because the water supply tank 17 is compactly stored in the body casing 10 of the microwave heating apparatus 100, the casing size of the microwave heating apparatus 100 need not be particularly increased. Accordingly, the installation area can be prevented from being enlarged.

Although the embodiment has been described on the case where the microwave heating apparatus is taken as an example of the heating apparatus to which the water supply tank unit 20 is attached, the water supply tank unit 20 is not limited thereto. For example, the water supply tank unit 20 may be applied to various kinds of equipment other than the microwave heating apparatus.

As described above in detail, in the water supply tank unit according to the invention, the protrusions are provided so that the protrusions climb over each other and are locked to each other when the water supply tank is attached/detached to/from the open/close member. Hence, the water supply tank can be attached into the open/close member steadily by the locking of the protrusions to each other and the state of attachment of the water supply tank can be checked easily. Accordingly, even in the case where it is difficult to store the water supply tank and check the attachment of the water supply tank, the water supply port of the water supply tank can be connected to the water intake port of the heating apparatus steadily. Water can be supplied to the heating apparatus side without water leakage, so that the moistening function of the heating apparatus can be effectuated well.

What is claimed is:

1. A water supply tank unit attached to a heating apparatus having a moistening function comprising:

a unit body attached to said heating apparatus;

an open/close member including a support portion for supporting said open/close member to said unit body on one side so as to make said open/close member opened/closed freely, and a lock portion for locking said open/close member on said unit body on the other side, said open/close member biased in a direction of departing from said unit body;

an operation member including an engagement portion engaged with said lock portion to keep said open/close member locked on said unit body, and a push button for unlocking said open/close member by a pushing-down operation of said push button; and a water supply tank held in said open/close member so as to be attachable/detachable, wherein said water supply tank and said open/close member have protrusions respectively so that said protrusions climb over each other and are locked to each other in a process of attaching/detaching said water supply tank.

2. A water supply tank unit according to claim 1, wherein said open/close member has at least one guide wall provided along a direction of attaching said water supply tank and abuts on said water supply tank to be attached in order to guide an attaching/detaching operation of said water supply tank.

3. A water supply tank unit according to claim 1, wherein said water supply tank has at least one rib provided along a direction of attaching said water supply tank and abuts on said open/close member in order to guide said water supply tank to a water supply tank retention position in said open/close member.

4. A water supply tank unit according to claim 1, wherein said open/close member has at least one guide wall provided along a direction of attaching said water supply tank and abuts on said water supply tank to be attached in order to guide an attaching/detaching operation of said water supply tank;

said water supply tank has at least one rib provided along a direction of attaching said water supply tank and abuts on said open/close member in order to guide said water supply tank to a water supply tank retention position in said open/close member; and said guide wall of said open/close member and said rib of said water supply tank are slid while engaged with each other when said water supply tank is attached/detached.

5. A water supply tank unit according to claims 1, wherein open/close member further has a water supply tank detection unit for detecting attachment/detachment of said water supply tank.

6. A water supply tank unit according to claim 5, wherein said water supply tank detection unit includes:

a driven member provided in said open/close member so as to be biased in a direction reverse to the direction of attaching said water supply tank and slid together with said water supply tank when pressed by part of said water supply tank inserted; and a switch for changing a state reversibly according to the sliding of said driven member, said water supply tank detection unit detects a state in which said water supply tank is attached into said open/close member and a state in which said water supply tank is detached from said open/close member.

7. A water supply tank unit according to claim 1, wherein said water supply tank has a pawl portion provided at a rear end in the direction of attaching said water supply tank into said open/close member so that a length of protrusion of said pawl portion backward in said attaching direction increases backward in a direction of pushing said open/close member into said unit body side.

* * * * *